US010153081B2

(12) United States Patent
Hirai et al.

(10) Patent No.: US 10,153,081 B2
(45) Date of Patent: Dec. 11, 2018

(54) COIL COMPONENT

(71) Applicant: Murata Manufacturing Co., Ltd., Kyoto (JP)

(72) Inventors: Shinya Hirai, Nagaokakyo (JP); Ryota Hashimoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/014,538

(22) Filed: Feb. 3, 2016

(65) Prior Publication Data

US 2016/0240304 A1 Aug. 18, 2016

(30) Foreign Application Priority Data

Feb. 13, 2015 (JP) ..... 2015-026743

(51) Int. Cl.
*H01F 27/29* (2006.01)
*H01F 17/04* (2006.01)
*H01F 27/28* (2006.01)

(52) U.S. Cl.
CPC ..... *H01F 27/29* (2013.01); *H01F 27/2823* (2013.01)

(58) Field of Classification Search
CPC ..... H01F 27/29; H01F 27/292; H01F 4/10; H01F 2005/043
(Continued)

(56) References Cited

U.S. PATENT DOCUMENTS 3,533,054 A * 10/1970 Mancini ..... H01F 5/04 439/733.1
3,585,450 A * 6/1971 Lane ..... H01F 41/10 310/194
(Continued)

FOREIGN PATENT DOCUMENTS

DE 102011116410 A1 4/2012
JP S63-187312 U 11/1988
(Continued)

OTHER PUBLICATIONS

An Office Action issued by the German Patent Office dated Dec. 14, 2016, which corresponds to German Patent Application No. 10 2016 202 050.1 and is related to U.S. Appl. No. 15/014,538; with English language translation.

*Primary Examiner* — Alexander Talpalatski
*Assistant Examiner* — Joselito Baisa
(74) *Attorney, Agent, or Firm* — Studebaker & Brackett PC

(57) ABSTRACT

A coil component has a pair of flange portions including a bottom surface that may be mounted on a mounting substrate and a top surface opposite to the bottom surface, a winding core portion coupling the pair of the flange portions, a top plate attached to the top surface of the flange portions, a metal terminal attached to each of the flange portions, and a wire wound around the winding core portion and electrically connected to the metal terminal. The metal terminal has a wire connecting portion connected to the wire and a flange connecting portion connected to the flange portion, and the wire connecting portion and the flange connecting portion are each located on the top surface side of a peripheral surface positioned between the bottom surface and the top surface of the flange portion.

1 Claim, 3 Drawing Sheets

(58) Field of Classification Search
USPC ..... 336/192, 221
See application file for complete search history.

(56) References Cited

U.S. PATENT DOCUMENTS 3,750,069 A * 7/1973 Renskers ..... H01F 17/043 336/192
4,706,058 A * 11/1987 Barbier ..... H01F 27/027 29/606
6,154,112 A * 11/2000 Aoba ..... H01F 27/292 336/185
6,157,283 A * 12/2000 Tsunemi ..... H01F 41/10 336/192
6,690,255 B2 * 2/2004 Caramela ..... H01F 27/2823 336/192
6,788,181 B2 * 9/2004 Yeh ..... H01F 27/027 336/192
6,960,976 B2 * 11/2005 Fan ..... H01F 27/292 336/192
7,071,803 B2 * 7/2006 Oki ..... H01F 27/027 336/192
7,183,886 B2 * 2/2007 Ooki ..... H01F 17/045 336/83
7,312,682 B2 * 12/2007 Yasuda ..... H01F 17/045 336/200
7,411,478 B2 * 8/2008 Hatakeyama ..... H01F 17/045 336/192
7,471,179 B2 * 12/2008 Hatakeyama ..... H01F 17/045 336/192
7,940,153 B2 * 5/2011 Watanabe ..... H01F 27/292 336/192
8,471,665 B2 * 6/2013 Urano ..... H01F 27/292 336/192
8,736,412 B2 * 5/2014 Nishino ..... H01F 17/045 336/192
9,245,682 B2 * 1/2016 Miura ..... H01F 27/02
2003/0179062 A1 * 9/2003 Kuwata ..... H01F 17/045 336/83
2004/0189433 A1 * 9/2004 Ooki ..... H01F 17/045 336/200
2006/0006970 A1 * 1/2006 Ooki ..... H01F 17/045 336/83
2006/0267719 A1 * 11/2006 Yasuda ..... H01F 17/045 336/223
2006/0284716 A1 * 12/2006 Yamaguchi ..... H01F 3/14 336/199
2007/0018770 A1 * 1/2007 Kamio ..... H01F 3/14 336/221
2008/0290975 A1 * 11/2008 Watanabe ..... H01F 17/045 336/90
2009/0315660 A1 * 12/2009 Oki ..... H01F 17/045 336/192
2010/0271162 A1 * 10/2010 Yan ..... H01F 17/04 336/98
2012/0119859 A1 * 5/2012 Nishino ..... H01F 17/045 335/297
2012/0133469 A1 * 5/2012 Tomonari ..... H01F 27/292 336/192
2013/0307657 A1 * 11/2013 Ohaga ..... H01F 27/292 336/192
2014/0292465 A1 * 10/2014 Takagi ..... H01F 27/292 336/192
2015/0042436 A1 * 2/2015 Arimitsu ..... H01F 27/29 336/192

FOREIGN PATENT DOCUMENTS

JP 11186064 A * 7/1999
JP H11-238634 A 8/1999
JP 2001-338817 A 12/2001
JP 2003-318030 A 11/2003
JP 2005-093564 A 4/2005
JP 2005-340621 A 12/2005
JP 2006-135291 A 5/2006
JP 2007-005769 A 1/2007
JP 3168133 U 5/2011
JP 5156076 B2 3/2013

* cited by examiner

COIL COMPONENT

CROSS REFERENCE TO RELATED APPLICATIONS

This application claims benefit of priority to Japanese Patent Application 2015-026743 filed Feb. 13, 2015, the entire content of which is incorporated herein by reference.

TECHNICAL FIELD

The present disclosure relates to a coil component.

BACKGROUND

Conventional coil components include a coil component described in Japanese Patent No. 5156076. This coil component has a pair of flange portions including bottom surfaces that may be mounted on a mounting substrate and top surfaces opposite to the bottom surfaces, a winding core portion coupling the pair of flange portions, metal terminals attached to the bottom surface side of the flange portions, a top plate attached to the top surfaces of the flange portions, and a wire wound around the winding core portion and electrically connected to the metal terminals. The wire is connected by welding to the metal terminals, and these welding parts are positioned in recesses disposed on the bottom surfaces.

SUMMARY

Problem to be Solved by the Disclosure

Since the conventional coil component has the welding parts between the metal terminals and the wire located on the bottom surface side of the flange portions, when the bottom surfaces of the flange portions are mounted via solder on the mounting substrate, the heat of the solder may be applied to the welding parts, and a problem of connection reliability may occur between the metal terminals and the wire.

Since surfaces of the metal terminals in contact with the flange portions are entirely attached via an adhesive to the flange portions, adhesion parts between the metal terminals and the flange portions are also located on the bottom surface side of the flange portions. Therefore, the heat of the solder may be applied to the adhesion parts, and a problem of connection reliability may occur between the metal terminals and the flange portions.

Therefore, a problem of the present disclosure is to provide a coil component capable of ensuring the connection reliability between a metal terminal and a wire as well as the connection reliability between a metal terminal and a flange portion.

Solutions to the Problems

To solve the problem, the present disclosure provides a coil component comprising:

a pair of flange portions including a bottom surface that may be mounted on a mounting substrate and a top surface opposite to the bottom surface;

a winding core portion coupling the pair of flange portions;

a top plate attached to the top surfaces of the flange portions;

a metal terminal attached to each of the flange portions; and a wire wound around the winding core portion and electrically connected to the metal terminal, wherein the metal terminal has a wire connecting portion connected to the wire, and the metal terminal has a flange connecting portion connected to the flange portion, and the wire connecting portion and the flange connecting portion are each located on the top surface side of a peripheral surface positioned between the bottom surface and the top surface of the flange portion.

According to the coil component of the present disclosure, the wire connecting portion and the flange connecting portion are each located on the top surface side of a peripheral surface positioned between the bottom surface and the top surface of the flange portion. Therefore, since the wire connecting portion and the flange connecting portion are located closer to the top surface, when the bottom surface of the flange portion is mounted on the mounting substrate via solder, the heat of the solder can be restrained from being applied to the wire connecting portion and the flange connecting portion, so as to ensure the connection reliability between the metal terminal and the wire as well as the connection reliability between the metal terminal and the flange portion.

Preferably, in the coil component of an embodiment, a recess is disposed on the top surface side of the peripheral surface of the flange portion, and the wire connecting portion and the flange connecting portion are positioned in the recess.

According to the coil component of the embodiment, since the flange connecting portion is positioned in the recess, when the metal terminal and the flange portion are connected by an adhesive, the adhesive can be kept in the recess to prevent the adhesive from dropping down to the bottom surface of the flange portion. Therefore, the heat of the solder can be restrained from being applied to the adhesive. Since the wire connecting portion is positioned in the recess, the wire connecting portion can be restrained from protruding from the outer shape of the flange portion, which facilitates the management of outer shape dimensions of the flange portion.

Preferably, in the coil component of an embodiment, an end portion of the recess on the bottom surface side is positioned closer to the top surface relative to a half of the height of the flange portion between the bottom surface and the top surface.

According to the coil component of the embodiment, since the end portion of the recess on the bottom surface side is positioned closer to the top surface relative to a half of the height of the flange portion between the bottom surface and the top surface, the wire connecting portion and the flange connecting portion can be separated away from the bottom surface and, even if the solder significantly wets the flange portion upward from the bottom surface thereof, the heat of the solder can further be restrained from being applied to the wire connecting portion and the flange connecting portion.

Preferably, in the coil component of an embodiment, the recess is opened to the top surface.

According to the coil component of the embodiment, since the recess is opened to the top surface, the adhesive for bonding the metal terminal and the flange portion can easily be poured from, for example, the top surface into the recess.

Effect of the Disclosure

According to the coil component of the present disclosure, the wire connecting portion and the flange connecting portion are each located on the top surface side of a peripheral surface positioned between the bottom surface and the top surface of the flange portion, the connection reliability can be ensured between the metal terminal and the wire as well as between the metal terminal and the flange portion.

DETAILED DESCRIPTION

The present disclosure will now be described in detail with reference to a shown embodiment.

Figure 1:
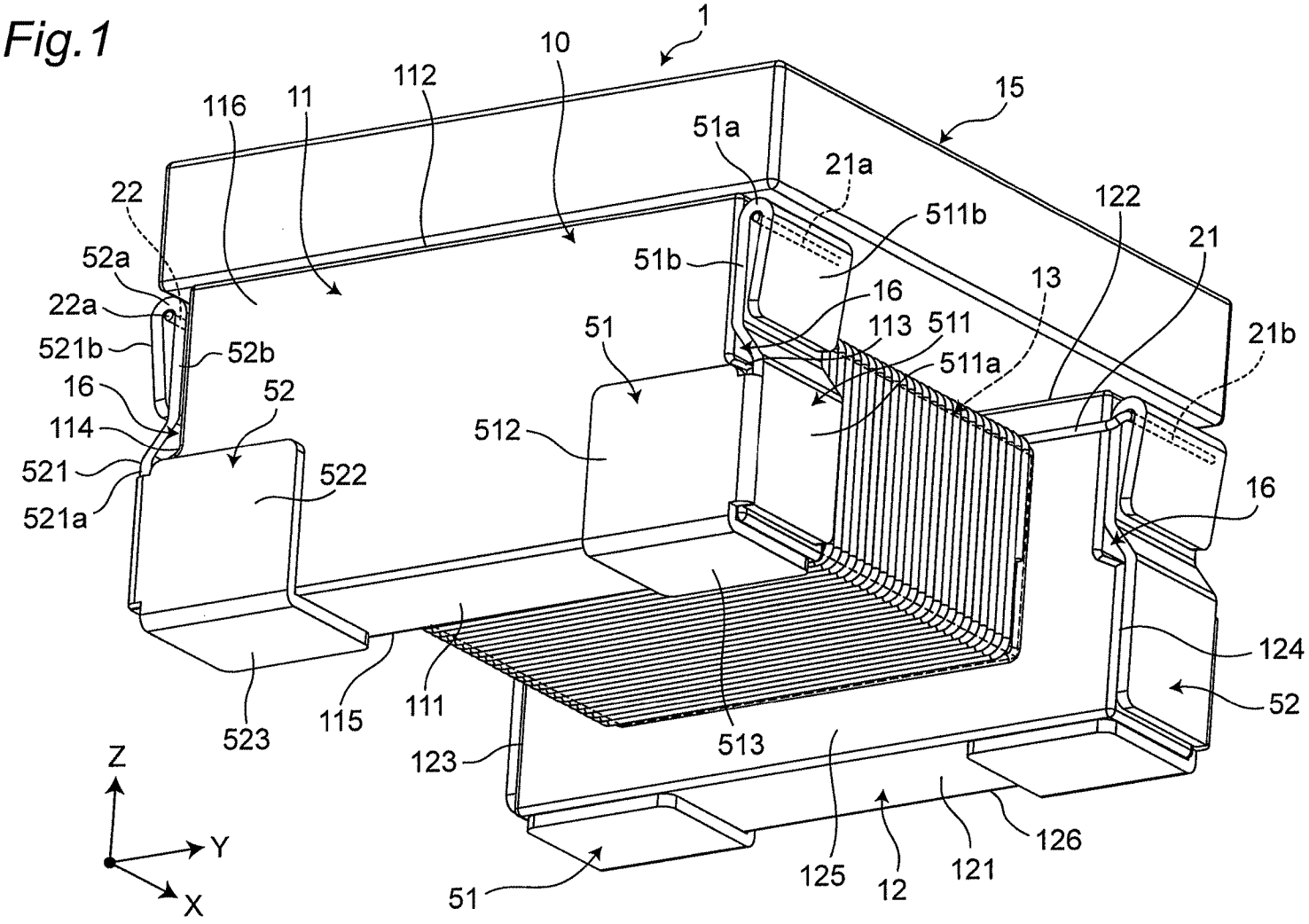
FIG. 1 is a perspective view of a coil component of an embodiment of the present disclosure.
Figure 2:
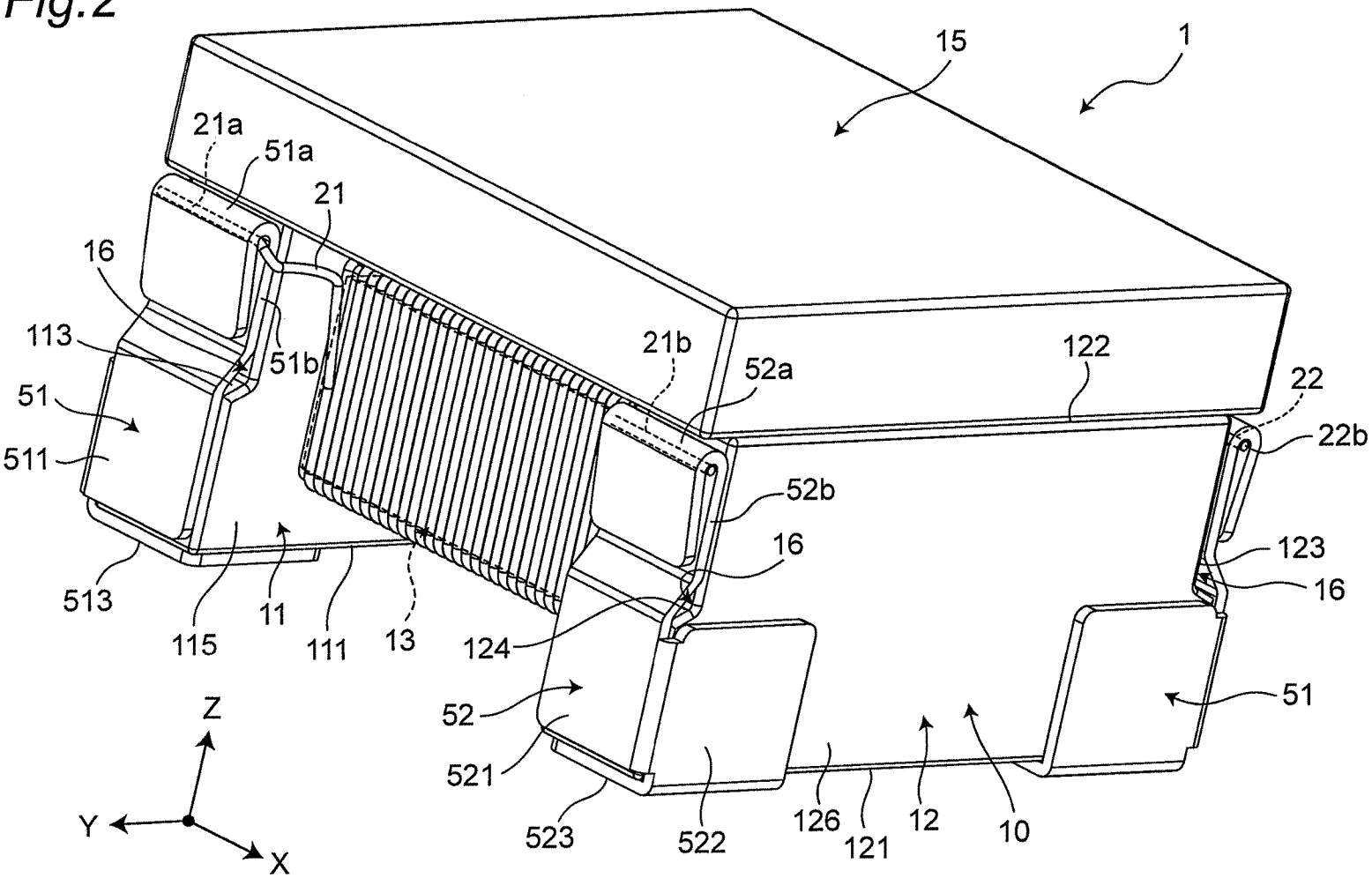
FIG. 2 is a perspective view of the coil component.

FIG. 1 is a perspective view of a coil component of an embodiment of the present disclosure. FIG. 2 is a perspective view of the coil component. As shown in FIGS. 1 and 2, a coil component 1 is a common mode choke coil. The coil component 1 has a core 10, a top plate 15 attached to the core 10, first and second metal terminals 51, 52 attached to the core 10, and first and second wires 21, 22 wound around the core 10 and electrically connected to the first and second metal terminals 51, 52.

The core 10 has a pair of first and second flange portions 11, 12 and a winding core portion 13 coupling the pair of the first and second flange portions 11, 12. The core 10 is made of a material having a dielectric constant of 20 or less, for example, alumina (non-magnetic material), Ni—Zn-based ferrite (magnetic material, insulating material), and resin.

A bottom surface of the core 10 is defined as a surface that may be mounted on a mounting substrate, and a top surface of the core 10 is defined as a surface on the side opposite to the bottom surface of the core 10. A direction (axial direction) of the winding core portion 13 coupling the first and second flange portions 11, 12 is defined as an X-direction, a direction orthogonal to the X-direction on the bottom surface of the core 10 is defined as a Y-direction, and a direction connecting the bottom surface and the top surface of the core 10 is defined as a Z-direction. The Z-direction is orthogonal to the X-direction and the Y-direction. The X-direction is defined as the length direction of the coil component 1, the Y-direction is defined as the width direction of the coil component 1, and the Z-direction is defined as the height direction of the coil component 1.

The winding core portion 13 axially extends from one end toward the other end thereof. A cross-sectional shape of the winding core portion 13 on a Y-Z plane is rectangular. The cross-sectional shape of the winding core portion 13 on the Y-Z plane may be another shape such as a circle.

The shape of the first flange portion 11 is a rectangular parallelepiped. The first flange portion 11 has a bottom surface 111 that may be mounted on the mounting substrate, a top surface 112 opposite to the bottom surface 111 in the Z-direction, and first and second side surfaces 113, 114 as well as inner and outer end surfaces 115, 116 as peripheral surfaces positioned between the bottom surface 111 and the top surface 112. The first side surface 113 and the second side surface 114 are opposite in the Y-direction. Viewing from the winding core portion 13, the first side surface 113 is a left surface and the second side surface 114 is a right surface. The inner end surface 115 and the outer end surface 116 are opposite in the X-direction. The inner end surface 115 is closer to the winding core portion 13. The first and second side surfaces 113, 114 and the inner and outer end surfaces 115, 116 are surfaces facing in directions different from the direction in which the top surface 112 faces.

The shape of the second flange portion 12 is a rectangular parallelepiped. As is the case with the first flange portion 11, the second flange portion 12 has a bottom surface 121, atop surface 122, a first side surface 123, a second side surface 124, an inner end surface 125, and an outer end surface 126.

The top plate 15 is attached to the top surface 112 of the first flange portion 11 and the top surface 122 of the second flange portion 12. The top plate 15 is made of the same material as the core 10. The core 10 and the top plate 15 make up a closed magnetic circuit.

The first metal terminals 51 are attached to the first side surface 113 of the first flange portion 11 and the first side surface 123 of the second flange portion 12. The second metal terminals 52 are attached to the second side surface 114 of the first flange portion 11 and the second side surface 124 of the second flange portion 12. The first and second metal terminal 51, 52 are formed by, for example, bending a metal plate of Cu, Ni, Sn, Au, etc. The first metal terminals 51 and the second metal terminals 52 are symmetrically formed.

The first and second wires 21, 22 are wound in a coil shape around the winding core portion 13. The first and second wires 21, 22 are wound as a pair at the same time, for example, and this is referred to as bifilar winding. The first and second wires 21, 22 have, for example, conductors made of Cu, Ag, Au, etc. and coating films covering the conductors.

A first end portion 21*a* of the first wire 21 is electrically connected to the first metal terminal 51 of the first flange portion 11. A second end portion 21*b* of the first wire 21 is electrically connected to the second metal terminal 52 of the second flange portion 12.

A first end portion 22*a* of the second wire 22 is electrically connected to the second metal terminal 52 of the first flange portion 11. A second end portion 22*b* of the second wire 22 is electrically connected to the first metal terminal 51 of the second flange portion 12.

The first and second metal terminals 51, 52 are electrically connected via solder to electrodes of the mounting substrate, and the first and second wires 21, 22 are electrically connected via the first and second metal terminals 51, 52 to the electrodes of the mounting substrate.

Figure 3:
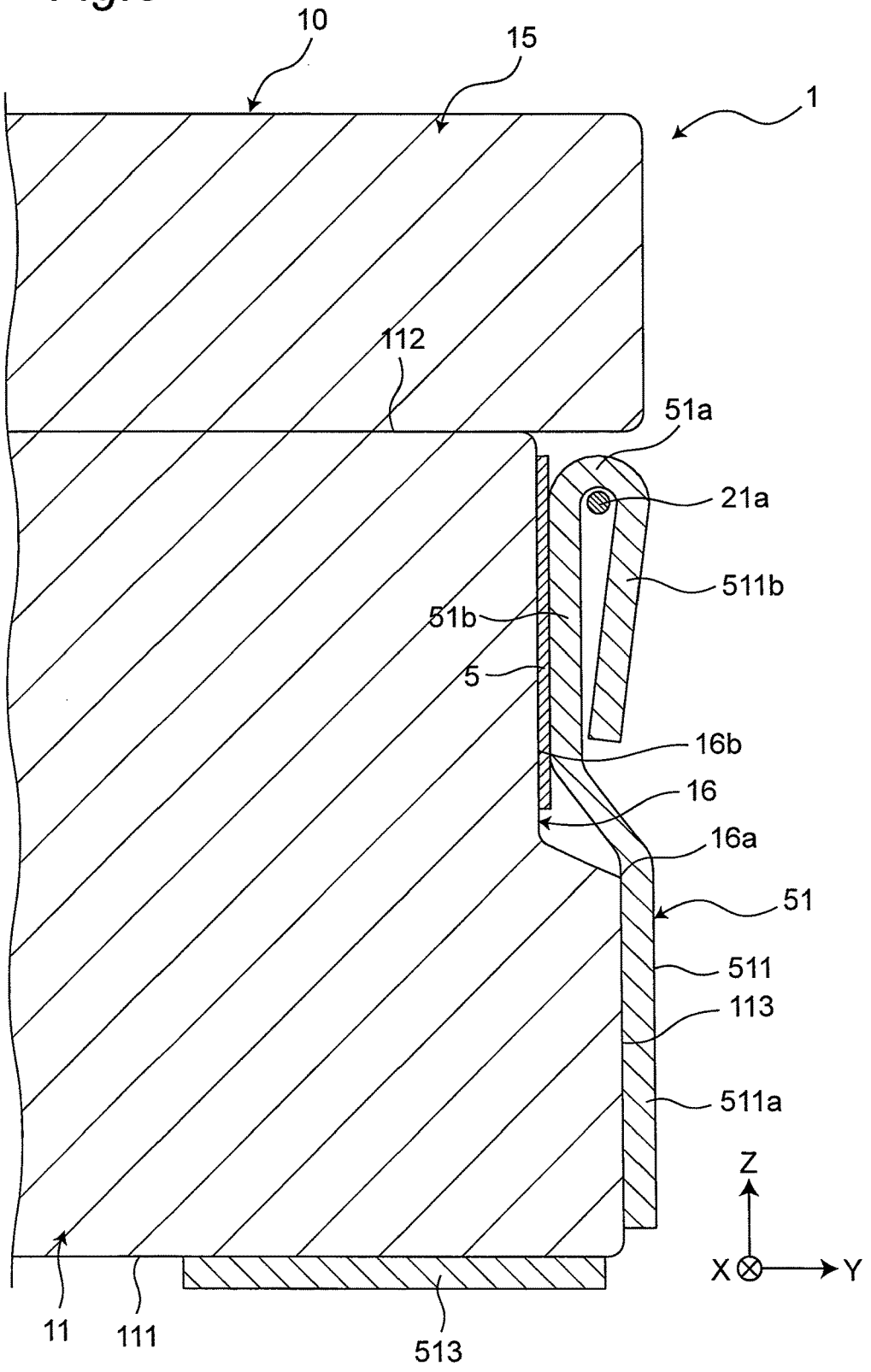
FIG. 3 is an enlarged cross-sectional view of a first metal terminal on the first flange portion side.

FIG. 3 is an enlarged cross-sectional view of the first metal terminal 51 attached to the first flange portion 11. As shown in FIGS. 1 and 3, the first metal terminal 51 has a first plate portion 511 facing the first side surface 113, a second plate portion 512 coupled to the first plate portion 511 and facing the outer end surface 116, and a third plate portion 513 coupled to the second plate portion 512 and facing the bottom surface 111.

The first plate portion 511 has a main body portion 511*a* coupled to the second plate portion 512 and a bending portion 511*b* positioned on the side of the first flange portion 11 as compared to the main body portion 511*a*. The bending portion 511*b* is bent to the side opposite to the first flange portion 11. The main body portion 511*a* is positioned closer to the bottom surface 111 and the bending portion 511*b* is positioned closer to the top surface 112.

The bending portion 511*b* sandwiches and holds the first end portion 21*a* of the first wire 21. The first wire 21 is electrically connected by, for example, thermocompression bonding or welding to the bending portion 511*b*. Therefore, the bending portion 511*b* includes a wire connecting portion 51*a* connected to the first wire 21. Additionally, the bending portion 511*b* is attached via an adhesive 5 to the first side surface 113. Therefore, the bending portion 511*b* includes a flange connecting portion 51*b* connected to the first flange portion 11.

The wire connecting portion 51*a* and the flange connecting portion 51*b* are each located on the top surface 112 side of the first side surface 113. Specifically, a recess 16 is disposed on the top surface 112 side of the first side surface 113. The bending portion 511*b* is located in the recess 16, and the wire connecting portion 51*a* and the flange connecting portion 51*b* are positioned in the recess 16.

The recess 16 is opened to the top surface 112, the inner end surface 115, and the outer end surface 116 and is not opened to the bottom surface 111. Therefore, the recess 16 has a step on the bottom surface 111 side. An end portion 16*a* of the step of the recess 16 on the bottom surface 111 side is positioned closer to the top surface 112 relative to a half of the height of the first flange portion 11 between the bottom surface 111 and the top surface 112.

A recessed surface 16*b* of the recess 16 is a surface facing in the Y-direction and, the adhesive 5 is applied to the recessed surface 16*b* to locate the wire connecting portion 51*a* and the flange connecting portion 51*b* on the recessed surface 16*b*. In other words, the wire connecting portion 51*a* and the flange connecting portion 51*b* are located on a surface of the first flange portion 11 facing in a direction different from the direction in which the top surface 112 faces. Therefore, the disposition area of the wire connecting portion 51*a* and the flange connecting portion 51*b* can be extended in a direction not parallel to the top surface 112. Thus, the recess 16 can be extended in a direction not parallel to the top surface 112.

In contrast, if the wire connecting portion 51*a* and the flange connecting portion 51*b* are disposed on a surface parallel to the top surface 112, the direction of disposition of the wire connecting portion 51*a* and the flange connecting portion 51*b* is extended in a direction parallel to the top surface 112. Therefore, the recess 16 is extended in a direction parallel to the top surface 112. As a result, the contact area between the top plate 15 and the top surface 112 becomes smaller and, therefore, the cross-sectional area of the closed magnetic circuit made up of the core 10 and the top plate 15 becomes smaller, resulting in a smaller inductance.

As shown in FIG. 1, the second metal terminal 52 attached to the first flange portion 11 has the same configuration as the first metal terminal 51. In particular, the second metal terminal 52 has a first plate portion 521 facing the second side surface 114, a second plate portion 522 coupled to the first plate portion 521 and facing the outer end surface 116, and a third plate portion 523 coupled to the second plate portion 522 and facing the bottom surface 111.

The first plate portion 521 has a main body portion 521*a* and a bending portion 521*b*. The bending portion 521*b* has a wire connecting portion 52*a* and a flange connecting portion 52*b*. The wire connecting portion 52*a* and the flange connecting portion 52*b* are each located on the top surface 112 side of the second side surface 114. Specifically, the recess 16 is disposed on the top surface 112 side of the second side surface 114, and the wire connecting portion 52*a* and the flange connecting portion 52*b* are positioned in the recess 16.

The recess 16 of the second side surface 114 has the same configuration as the recess 16 of the first side surface 113. In particular, the recess 16 is opened to the top surface 112, the inner end surface 115, and the outer end surface 116 and is not opened to the bottom surface 111. The end portion 16*a* of the recess 16 on the bottom surface 111 side is positioned closer to the top surface 112 relative to a half of the height of the first flange portion 11 between the bottom surface 111 and the top surface 112. The wire connecting portion 52*a* and the flange connecting portion 52*b* are located on the recessed surface 16*b* of the recess 16. In other words, the wire connecting portion 52*a* and the flange connecting portion 52*b* are located on a surface of the first flange portion 11 facing in a direction different from the direction in which the top surface 112 faces.

The configurations of the first and second metal terminals 51, 52 attached to the second flange portion 12 are the same as the configurations of the first and second metal terminals 51, 52 attached to the first flange portion 11 and therefore will not be described. The recesses 16 disposed on the first and second side surfaces 123, 124 of the second flange portion 12 are the same as the recesses 16 disposed on the first flange portion 11 and therefore will not be described.

The first metal terminal 51 attached to the first flange portion 11 of the coil component 1 has the following effect. The second metal terminal 52 attached to the first flange portion 11 and the first and second metal terminals 51, 52 attached to the second flange portion 12 have the same effect and therefore will not be described.

The wire connecting portion 51*a* and the flange connecting portion 51*b* are each located on the top surface 112 side of the first side surface 113 positioned between the bottom surface 111 and the top surface 112 of the first flange portion 11. Therefore, since the wire connecting portion 51*a* and the flange connecting portion 51*b* are located closer to the top surface 112, when the bottom surface 111 of the first flange portion 11 is mounted on the mounting substrate via solder, the heat of the solder can be restrained from being applied to the wire connecting portion 51*a* and the flange connecting portion 51*b*, so as to ensure the connection reliability between the first metal terminal 51 and the first wire 21 as well as the connection reliability between the first metal terminal 51 and the first flange portion 11.

Since the wire connecting portion 51*a* is not located on the top surface 112 of the first flange portion 11, the contact area between the top surface 112 of the first flange portion 11 and the top plate 15 can be made wider and, therefore, the cross-sectional area of the closed magnetic circuit made up of the core 10 and the top plate 15 becomes larger so that a high inductance can be acquired even when the size is small.

Since the flange connecting portion 51*b* is positioned in the recess 16, when the first metal terminal 51 and the first flange portion 11 are connected by the adhesive 5, the adhesive 5 can be kept in the recess 16 to prevent the adhesive 5 from dropping down to the bottom surface 111 of the first flange portion 11. Therefore, the heat of the solder can be restrained from being applied to the adhesive 5. Since the wire connecting portion 51*a* is positioned in the recess 16, the wire connecting portion 51*a* can be restrained from protruding from the outer shape of the first flange portion 11, which facilitates the management of outer shape dimensions of the first flange portion 11.

Since the end portion 16*a* of the recess 16 on the bottom surface 111 side is positioned closer to the top surface 112 relative to a half of the height of the first flange portion 11 between the bottom surface 111 and the top surface 112, the wire connecting portion 51*a* and the flange connecting portion 51*b* can be separated away from the bottom surface 111 and, even if the solder significantly wets the first flange portion 11 upward from the bottom surface 111 of the first flange portion 11, the heat of the solder can further be restrained from being applied to the wire connecting portion 51*a* and the flange connecting portion 51*b*.

Since the recess 16 is opened to the top surface 112, the adhesive 5 for connecting the first metal terminal 51 and the first flange portion 11 can easily be poured from the top surface 112 into the recess 16. For example, transferring, dispensing, etc. can be used for a method of pouring the adhesive 5.

Since the flange connecting portion 51*b* of the first metal terminal 51 is positioned on the first side surface 113 of the first flange portion 11, the first plate portion 511 of the first metal terminal 51 is bonded to the first side surface 113. Therefore, the second plate portion 512 and the third plate portion 513 are not bonded to the bottom surface 111 and the outer end surface 116, and a gap can be disposed between the second plate portion 512 and the outer end surface 116 as well as between the third plate portion 513 and the bottom surface 111.

When the second plate portion 512 and the third plate portion 513 are mounted on the mounting substrate by the solder and deflection occurs in the mounting substrate, a stress due to the deflection is applied to the first metal terminal 51; however, this stress is hardly transmitted to the first flange portion 11 because of the gap between the second plate portion 512 and the outer end surface 116 and the gap between the third plate portion 513 and the bottom surface 111. Therefore, even if vibration or impact is applied to the mounting substrate, the first metal terminal 51 absorbs the stress due to the vibration or impact and applies no load to the first flange portion 11.

The present disclosure is not limited to the embodiment described above and can be changed in design without departing from the spirit of the present disclosure. For example, the numbers of the metal terminals and the wires can be increased or decreased. The shape of the flange portions is not limited to a rectangular parallelepiped and may be a square column or a circular column including a bottom surface and a top surface.

Although the wire connecting portion and the flange connecting portion of the first metal terminal attached to the first flange portion are each located on the first side surface of the first flange portion, the portions may be located on any of the peripheral surfaces, i.e., the first and second side surfaces and the inner and outer end surfaces, positioned between the bottom surface and the top surface of first flange portion. Although the wire connecting portion and the flange connecting portion are each located on the same first side surface, the portions may be located on different surfaces. The same applies to the second metal terminal attached to the first flange portion and the first and second metal terminals attached to the second flange portion.

Although the recesses are disposed on the first and second side surfaces of the first and second flange portions and the wire connecting portions and the flange connecting portions are located in the recesses, flat surfaces may be formed without disposing the recesses on the first and second side surfaces, and the wire connecting portions and the flange connecting portions may be located on the flat surfaces.

Although the recesses are disposed on the first and second side surfaces of the first and second flange portions, the recesses may be disposed on the inner and outer end surfaces of the first and second flange portions, and the wire connecting portions and the flange connecting portions may be located in the recesses.

Although each of the recesses is opened to the top surface, the inner end surface, and the outer end surface, the recess may be opened to at least one of the top surface, the inner end surface, and the outer end surface, or may be opened to none of the top surface, the inner end surface, and the outer end surface.

Although the end portions of the recesses on the bottom surface side are positioned closer to the top surfaces relative to a half of the height of the first and second flange portions between the bottom surfaces and the top surfaces, the end portions may be positioned closer to the bottom surfaces relative to a half of the height of the first and second flange portion between the bottom surfaces and the top surfaces.

The invention claimed is:

1. A coil component comprising:

a pair of flange portions each including a bottom surface that may be mounted on a mounting substrate and a top surface opposite to the bottom surface;

a winding core portion coupling the pair of the flange portions;

a top plate attached to the top surfaces of the flange portions;

a metal terminal attached to each of the flange portions; and a wire wound around the winding core portion and electrically connected to one of the metal terminals, wherein the one of the metal terminals has a wire connecting portion connected to the wire and a flange connecting portion connected to the corresponding flange portion, and the wire connecting portion and the flange connecting portion are each located on a top surface side of a peripheral surface positioned between the bottom surface and the top surface of the corresponding flange portion, the top surface side being positioned to be spaced from the bottom surface in a direction toward the top surface, a recess is disposed on the top surface side of the peripheral surface of the corresponding flange portion, and the wire connecting portion and the flange connecting portion are positioned in the recess, the recess has a recessed surface that faces in a direction different from a direction in which the top surface faces and that faces in a direction in which a bottom surface side of the peripheral surface faces, the wire connecting portion and the flange connecting portion each being located on the recessed surface, the flange connecting portion of the metal terminal is bonded to the corresponding flange portion by a bonding material between the recessed surface and the flange connecting portion, the bonding material is provided only in the recess, and the recess is recessed from the peripheral surface continuously to the top surface of the flange portion such that the recess is opened to the top surface.

* * * * *